United States Patent [19]

Varmo

[11] Patent Number: 4,700,628

[45] Date of Patent: Oct. 20, 1987

[54] SMOKE GRENADE

[75] Inventor: Kjell O. Varmo, Raufoss, Norway

[73] Assignee: A/S Raufoss Ammunisjonsfabrikker A/S, Raufoss, Norway

[21] Appl. No.: 945,096

[22] PCT Filed: Apr. 14, 1986

[86] PCT No.: PCT/NO86/00029

§ 371 Date: Dec. 1, 1986

§ 102(e) Date: Dec. 1, 1986

[87] PCT Pub. No.: WO86/06468

PCT Pub. Date: Nov. 6, 1986

[51] Int. Cl.[4] ..... I42B 13/44

[52] U.S. Cl. ..... 102/33.4; 102/339; 102/343; 102/348; 102/464; 102/502; 102/503

[58] Field of Search ..... 102/334, 339, 343, 348, 102/349, 464, 502, 503

[56] References Cited

U.S. PATENT DOCUMENTS

| | | | |
|---|---|---|---|
| 3,150,875 | 9/1964 | Searles | 102/334 X |
| 3,715,668 | 2/1973 | Herring et al. | 201/339 X |
| 4,162,053 | 7/1979 | Bjornson | 201/348 X |
| 4,474,715 | 10/1984 | Weber et al. | 201/334 X |
| 4,621,579 | 11/1986 | Badura et al. | 201/334 X |

*Primary Examiner*—Peter A. Nelson

*Attorney, Agent, or Firm*—Larson and Taylor

[57] ABSTRACT

A smoke grenade comprising a launching device (1), an instantaneous smoke device (2) and an IR-smoke generator (3) is provided with a casing (4) which can be deformed to guiding/supporting fins (4').

1 Claim, 4 Drawing Figures

SMOKE GRENADE

The present invention refers to a smoke grenade comprising an infrared smoke generator and an instantaneous smoke charge, as well as a launching device comprising an explosive propelling charge which can be electrically ignited. It is previously known several types of smoke grenades and smoke generating devices, such as those disclosed in the Norwegian Pat. Nos. 142.930, 145.521, 142.929 and 142.928. The instantaneous smoke charge shall deliver smoke in a relatively short time after launching whereas the IR-smoke generator on a later stage shall deliver an IR-smoke absorbing in the infra-red part of the electromagnetic specter.

A possible drawback with regard to smoke grenades of this type is that the IR-smoke generator may drop down in snow or the smoke delivering opening may face moist ground which will reduce the efficiency of the smoke generated, which in most cases will contain highly hydroscopic components.

The drawback of the prior art smoke grenades is in accordance with the invention obviated in that the smoke grenade is provided with means which to a certain degree will guide the grenade during its flight and which after grounding will prevent the grenade from taking a disadvantageous position on the ground or will prevent it from sinking down in snow. In accordance with the invention this object is obtained in that the instantaneous smoke charge comprising a tubelike element which may be provided with weakenings or may be slottred such that when the instantaneous smoke charge explodes the tube will be torn up and form a sleeve which will guide and support the IR-smoke generator during its flight.

Figure 1:
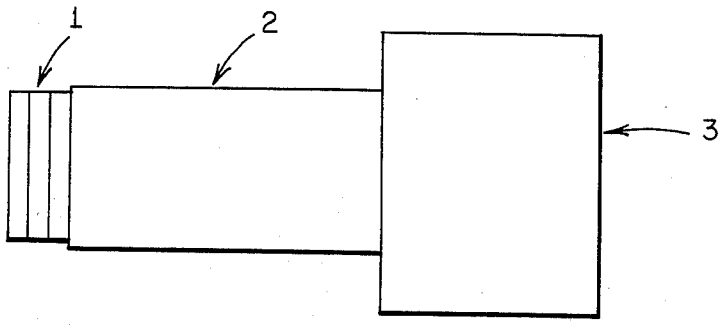
Figure 2:
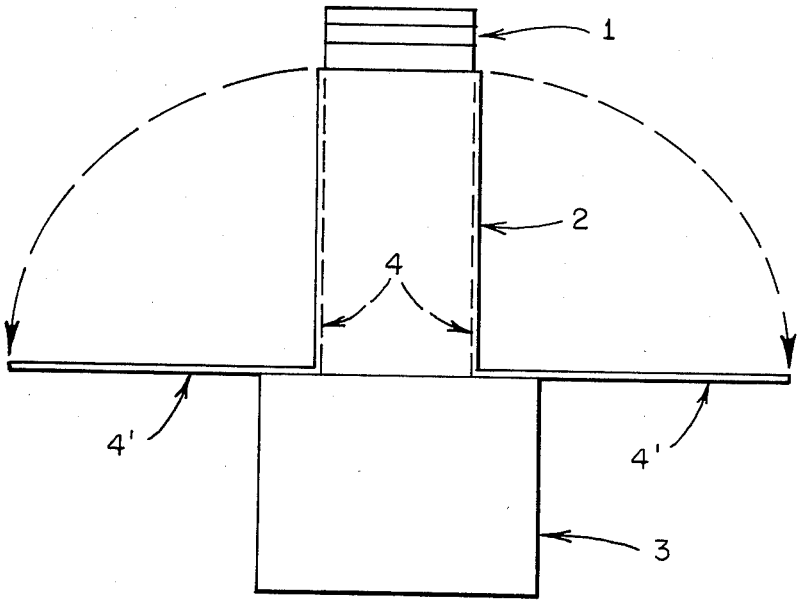
Figure 3:
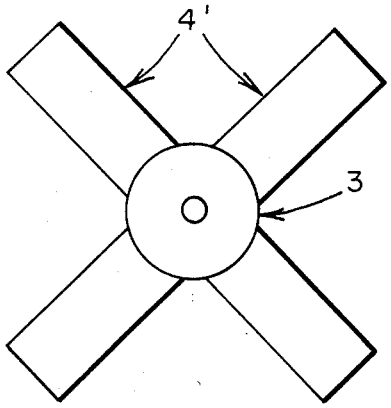
Figure 4:
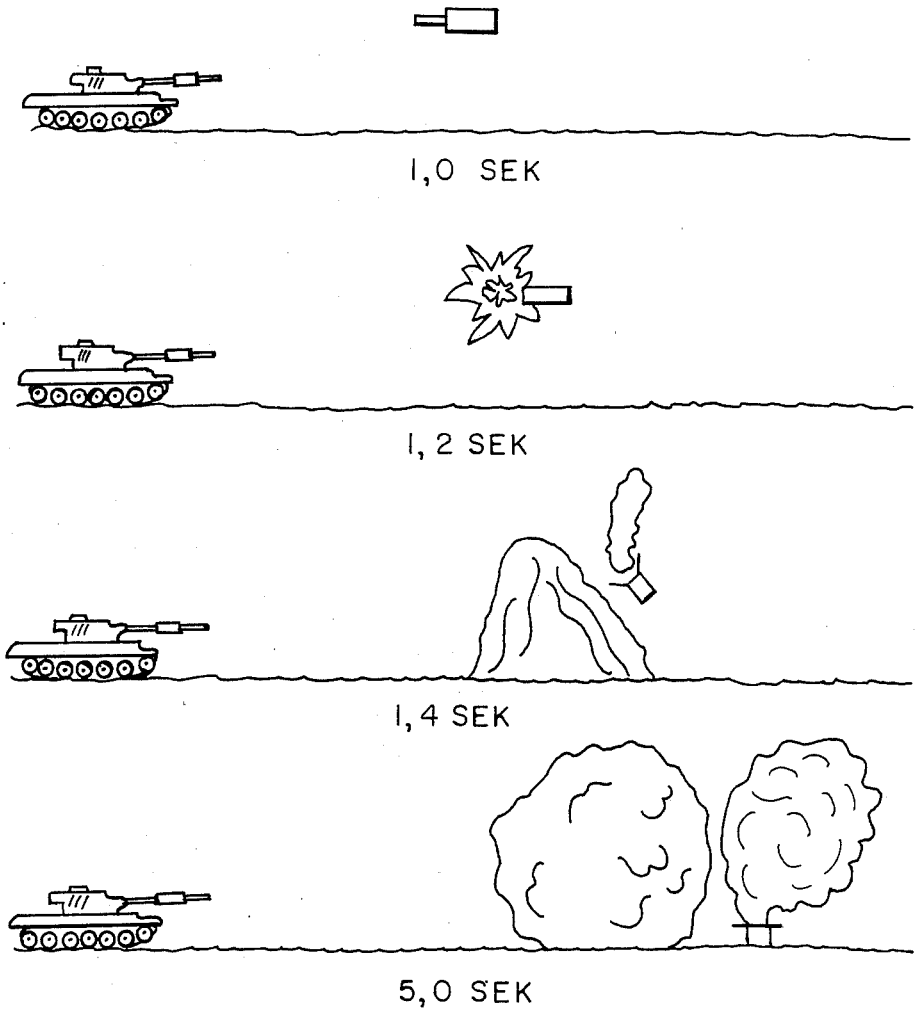

The invention shall be described with reference to the enclosed drawings in which FIG. 1 shows a prior art smoke grenade, FIG. 2 shows the new grenade with the tube or casing forming the sleeve FIG. 3 shows the casing in an unfolded condition such that it forms guiding/supporting wings, and FIG. 4 shows different stages after launching of the new smoke grenade.

In FIG. 1 is shown a smoke grenade comprising an optionally electrical ignited launching device 1, the instantaneous smoke charge 2 and an IR-smoke generator 3. The part 2 can for instance contain a smoke charge consisting of smoke bodies e.g. of the type disclosed in Norwegian Pat. No. 142.930 whereas the IR-smoke generator can contain an IR-smoke charge known per se.

In FIG. 2 a tubelike body with weakenings is indicated by a broken line 4, which after the explosion of the instantaneous smoke part 2 has will unfold out and form the protruding marked with 4'.

In FIG. 3 the smoke grenade is shown seen from above with the parts 4' in an unfolded position. In FIG. 3 four protruding parts 4 or fins are shown but the number of protruding parts can be chosen as required. Another embodiment of the fins is also possible in that the part 4 is constructed of folded material which after the explosion of the part 2 forms a more or less continuous funnel-shaped body which will be effective in snow.

I claim:

1. Smoke grenade comprising a launching device (1), an instantaneous smoke charge device (2) and an IR-smoke generator (3) and in which the smoke grenade during its flight is provided with guiding-supporting fins (4'), characterized in that the instantaneous smoke charge (2) is housed in a tubelike body (4) provided with a number of slots or weakenings which when the smoke charge (2) explodes, will unfold and form the guiding/supporting fins (4').

* * * * *